US010575649B2

(12) United States Patent
Pelletier

(10) Patent No.: US 10,575,649 B2
(45) Date of Patent: Mar. 3, 2020

(54) FASTENERLESS ERGONOMIC KNEE REST UNITARY CONSTRUCTION CHAIR

(71) Applicant: Mead Timothy Pelletier, Cornwallville, NY (US)

(72) Inventor: Mead Timothy Pelletier, Cornwallville, NY (US)

( * ) Notice: Subject to any disclaimer, the term of this patent is extended or adjusted under 35 U.S.C. 154(b) by 0 days.

(21) Appl. No.: 16/005,095

(22) Filed: Jun. 11, 2018

(65) Prior Publication Data

US 2018/0352963 A1 Dec. 13, 2018

Related U.S. Application Data

(60) Provisional application No. 62/603,691, filed on Jun. 9, 2017.

(51) Int. Cl.

| | |
|---|---|
| ***A47C 9/00*** | (2006.01) |
| ***A47C 5/00*** | (2006.01) |
| ***A47C 7/00*** | (2006.01) |

(52) U.S. Cl.

CPC ..... *A47C 9/005* (2013.01); *A47C 5/00* (2013.01); *A47C 7/006* (2013.01)

(58) Field of Classification Search

CPC ..... A47C 9/005; A47C 9/002; A47C 4/021; A47C 5/00; A47C 5/14; A47C 7/006; A47B 2200/0096

USPC ..... 297/423.12, 423.1, 423.11

See application file for complete search history.

(56) References Cited

U.S. PATENT DOCUMENTS

| | | | | |
|---|---|---|---|---|
| 1,697,671 A | | 1/1929 | Watson et al. | |
| 3,669,493 A | | 6/1972 | Vowles et al. | |
| 3,695,684 A | | 10/1972 | Barberg et al. | |
| 4,340,251 A | * | 7/1982 | Geoffroy-Dechaume | A47C 4/021 297/440.12 |
| 4,593,950 A | * | 6/1986 | Infanti | A47C 3/029 297/130 |
| 4,746,167 A | | 5/1988 | Palmer et al. | |
| 5,186,519 A | * | 2/1993 | Larson | A47C 9/005 297/338 |
| 5,275,467 A | * | 1/1994 | Kawecki | A47C 4/021 297/411.29 |
| 5,496,247 A | | 3/1996 | Anderson | |
| 5,605,378 A | * | 2/1997 | Oyediran | A47C 4/021 297/440.13 |
| 5,803,548 A | * | 9/1998 | Battle | A47C 3/029 297/271.6 |
| 5,927,816 A | | 7/1999 | Hsu | |
| 5,992,938 A | * | 11/1999 | Jones | A47C 4/021 297/440.13 |

(Continued)

*Primary Examiner* — Mark R Wendell

(74) *Attorney, Agent, or Firm* — Dunlap Bennett & Ludwig PLLC

(57) ABSTRACT

A knee-rest economic chair is provided. The knee-rest economic chair is formed from a unitary construction, fastener-less assembly, wherein the chair provides an elevated posterior condition as an elevated knee rest for seated users. The chair may be assembled from a plurality of components all of which are formed from a planar blank of one material. The components have tabs and slots for joined adjacent components that results in a seat component spaced apart and elevated above a knee support component, positioned relative to each other in an elevated posterior position, wherein gravity secures the resulting tab-slot and slot-slot joints, making separate fasteners unnecessary.

15 Claims, 4 Drawing Sheets

(56) References Cited

U.S. PATENT DOCUMENTS

| | | | | |
|---|---|---|---|---|
| 6,582,022 | B2 * | 6/2003 | LaBlance | A47C 5/12 29/525.11 |
| 6,619,749 | B2 * | 9/2003 | Willy | A47B 3/06 108/158.12 |
| 6,848,747 | B1 | 2/2005 | Robinson | |
| 7,017,996 | B2 | 3/2006 | Peterson | |
| 8,141,956 | B2 | 3/2012 | Schouten et al. | |
| D673,381 | S | 1/2013 | McShane | |
| 9,919,178 | B2 | 3/2018 | Morton | |
| 9,930,968 | B2 | 4/2018 | Wilkinson | |
| 2002/0063463 | A1 * | 5/2002 | Leong | A47C 4/021 297/440.12 |
| 2007/0278834 | A1 | 12/2007 | Kielland | |
| 2009/0066140 | A1 * | 3/2009 | Berent | A47B 3/06 297/440.13 |
| 2009/0102267 | A1 | 4/2009 | Larocque | |
| 2012/0280550 | A1 * | 11/2012 | College | A47C 4/021 297/411.2 |
| 2013/0080286 | A1 * | 3/2013 | Rotholz | A47C 5/005 705/26.5 |
| 2014/0049088 | A1 | 2/2014 | Appiah Finn | |
| 2014/0165289 | A1 | 6/2014 | Trocchia et al. | |
| 2018/0168354 | A1 * | 6/2018 | O'Neill | A47C 1/143 |
| 2019/0059594 | A1 * | 2/2019 | Davis | A47C 4/021 |

* cited by examiner

FASTENERLESS ERGONOMIC KNEE REST UNITARY CONSTRUCTION CHAIR

CROSS-REFERENCE TO RELATED APPLICATION

This application claims the benefit of priority of U.S. provisional application No. 62/603,691, filed 9 Jun. 2017, the contents of which are herein incorporated by reference.

BACKGROUND OF THE INVENTION

The present invention relates to seats and, more particularly, to a knee-rest economic chair formed from a unitary construction, fastener-less assembly, wherein the chair provides an elevated posterior condition for seated users, for example when the seated user is accompanied by high countertop surfaces.

Most knee rest economic chair designs are crafted with metal and plastics, and not from a single half sheet of material with no fasteners, making assembly more challenging and presenting the risk of losing a fastener and thus frustrating the entire assembly process. Additionally, many knee-rest economic chairs fail to provide a sufficient elevation for the seated user, or more specifically to provide sufficient stability at higher elevations for seated users.

A wood-only construction would result in a 100 percent recyclable article, which has a pleasant aesthetic and tactile look and feel. Furthermore, a wood-only construction formed from a unitary blank would increase cost savings since the wood industry sells in recycled, composite wood in sheets, such as plywood. Furthermore, a templated design applied to a unitary sheet of construction material would further affords cost savings—e.g., an individual with a CNC machine can construct all the necessary components—that can be passed on the consumers as both a finished product and as a template for crafters, making it easily reproduceable by crafters.

As can be seen, there is a need for a knee-rest economic chair formed from a unitary fastener-less assembly, wherein the economic chair design incorporates an elevated posterior condition for users. The unitary and fastener-less construction provides an affordable and easily reproducible design made from only one material. The unitary blank is a three-dimensional puzzle contained in, typically, a 48" by 48" square area, which is an industry standard plywood dimension, further promoting an affordable product.

SUMMARY OF THE INVENTION

In one aspect of the present invention, a system for providing the components for assembling a knee-rest chair in a planar arrangement includes a planar blank of one material defining a plurality of components providing two U-shaped upright components having coextensive distal portions and coextensive proximal portions, wherein the proximal portions extend farther from a base portion of each U-shaped upright component; two intermediate components for spacing the two U-shaped upright components apart of the assembled knee-rest chair; a seat component adapted to operatively engage the proximal portions of the assembled knee-rest chair; and a knee support component adapted to operative engage the distal portions of the assembled knee-rest chair.

In another aspect of the present invention, the system for providing the components for assembling a knee-rest chair in a planar arrangement includes a planar blank of one material defining a plurality of components providing two U-shaped upright components having coextensive distal portions and coextensive proximal portions, wherein the proximal portions extend farther from a base portion of each U-shaped upright component; two intermediate components for spacing the two U-shaped upright components apart of the assembled knee-rest chair; a seat component adapted to operatively engage the proximal portions of the assembled knee-rest chair; and a knee support component adapted to operative engage the distal portions of the assembled knee-rest chair; a plurality of tabs and or slots on each of the plurality of components for operatively engaging each other for providing the assembled knee-rest chair without the use of separate fasteners; a bottom component disposed between the two intermediate components and interconnecting said base portions of the assembled knee-rest chair; and a plurality of wheels defined by the planar blank, wherein the two upright components provide two wheel portions for rotatably associating with the plurality of wheels of the assembled knee-rest chair.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a knee-rest economic chair formed from a unitary construction, fastener-less assembly, wherein the chair provides an elevated posterior condition for seated users. The chair may be assembled from a plurality of components all of which are formed from a planar blank of one material. The components have tabs and slots for joined adjacent components that results in a seat component spaced apart and elevated above a knee support component, positioned relative to each other in an elevated posterior position, wherein gravity secures the resulting tab-slot and slot-slot joints, making separate fasteners unnecessary.

Referring to FIGS. 1 through 4, the present invention may include an economic chair system 100 formed from a unitary construction, fastener-less assembly, the unitary construction provided through a planar blank 28 defining all the constituent components for the assembled economic chair 10 having an elevated posterior profile. The planar blank 28 may be of one standardized dimensionally sized material.

Figure 1:
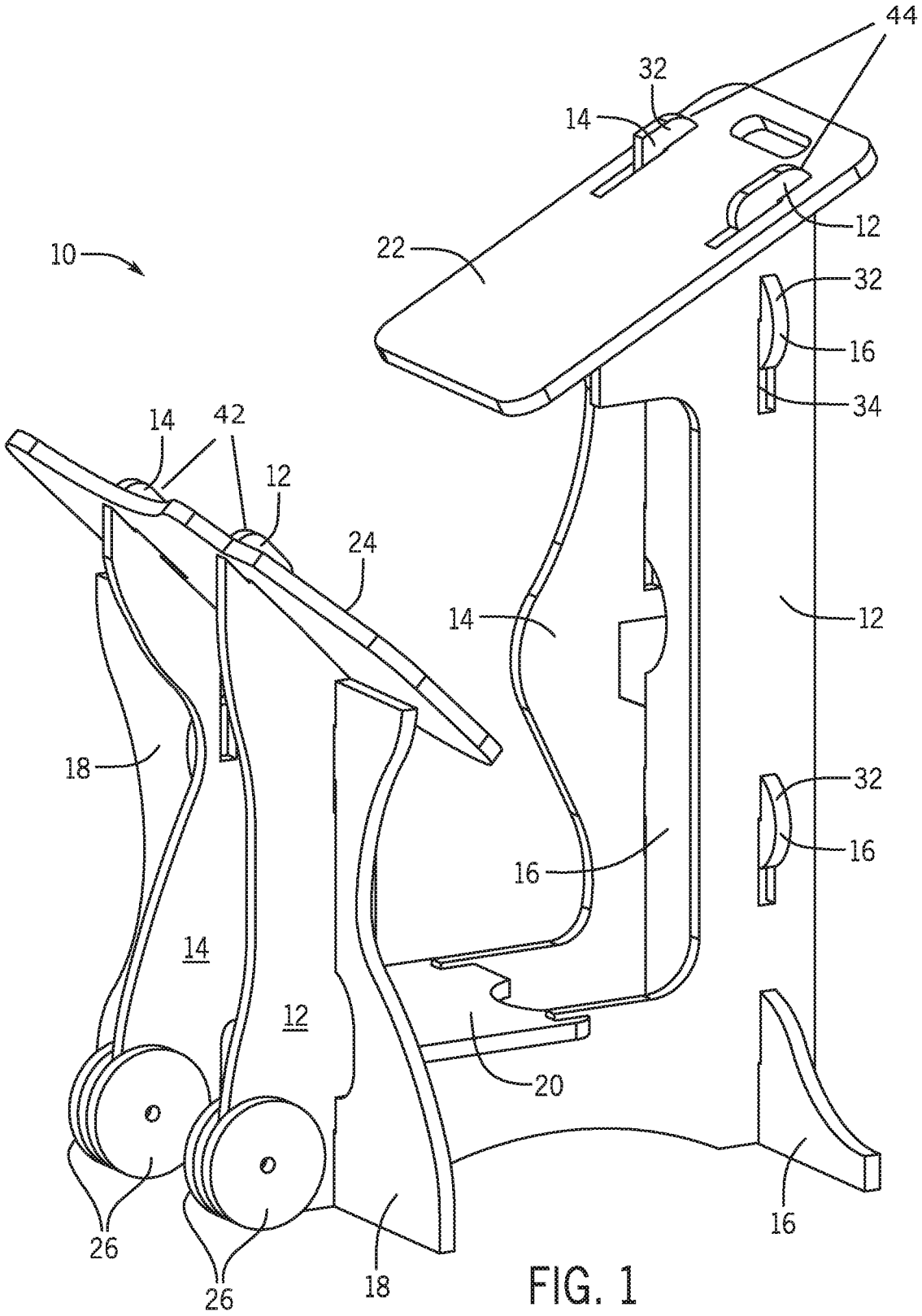
FIG. 1 is a front perspective view of an exemplary embodiment of the present invention.
Figure 2:
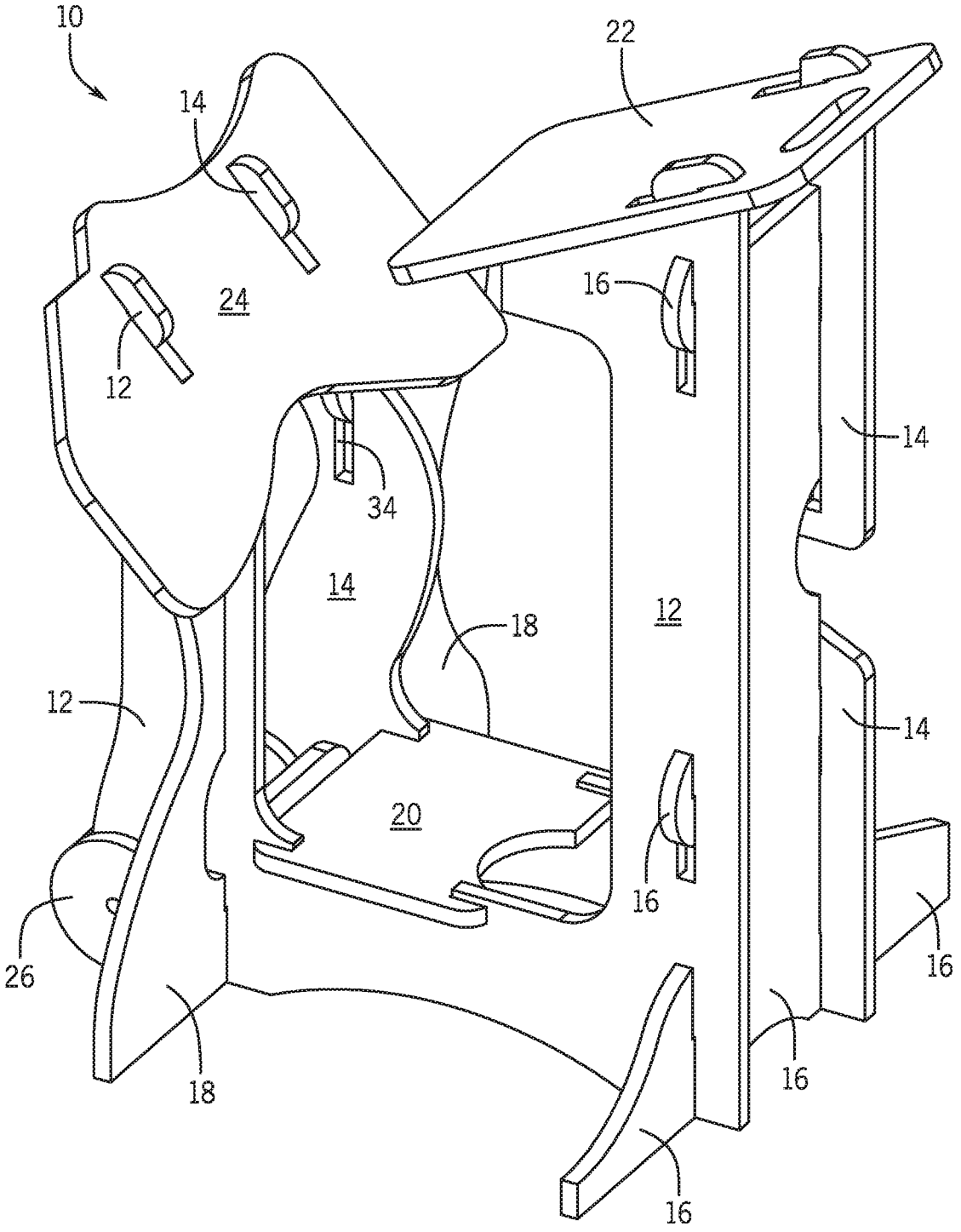
FIG. 2 is a rear perspective view of an exemplary embodiment of the present invention.
Figure 3:
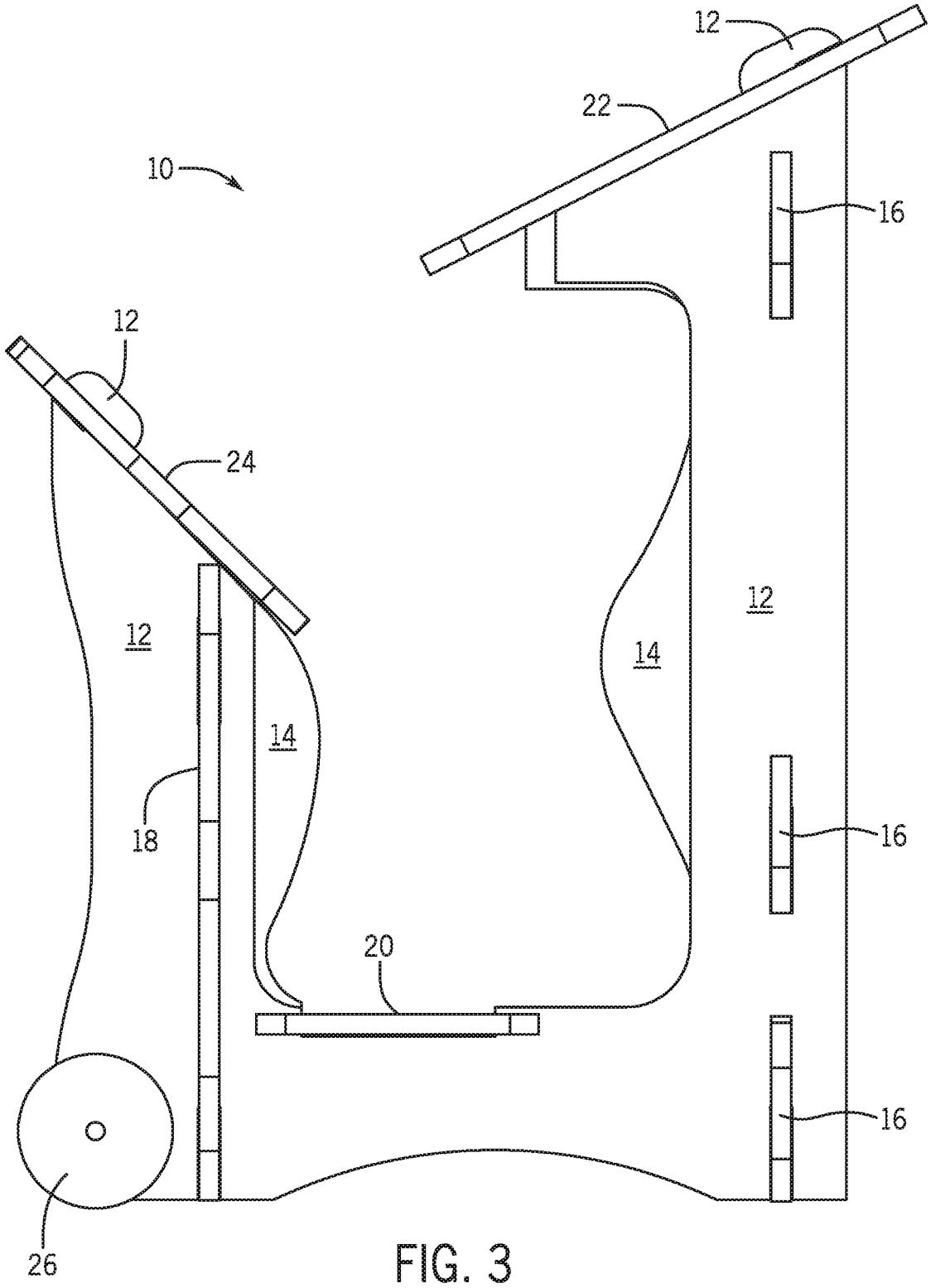
FIG. 3 is a side elevation view of an exemplary embodiment of the present invention.

It should be understood by those skilled in the art that the use of directional terms such as left, right, downward, and the like are used in relation to the illustrative embodiments as they are depicted in the figures, the left direction being toward the left of the FIG. 1 and a downward direction being toward the bottom of the FIGS. 1 through 3.

The planar blank 28 may be 48 inches by 48 inches, which is a standard plywood sheet size. Though it should be understood that the planar blank 48 may be made of not just any wood type, but any material providing the strength, when assemble, to accommodate the size and weight of a human user. Likewise the overall dimensions of the planar blank 28 may be greater or smaller than 48 by 48 inches.

Figure 4:
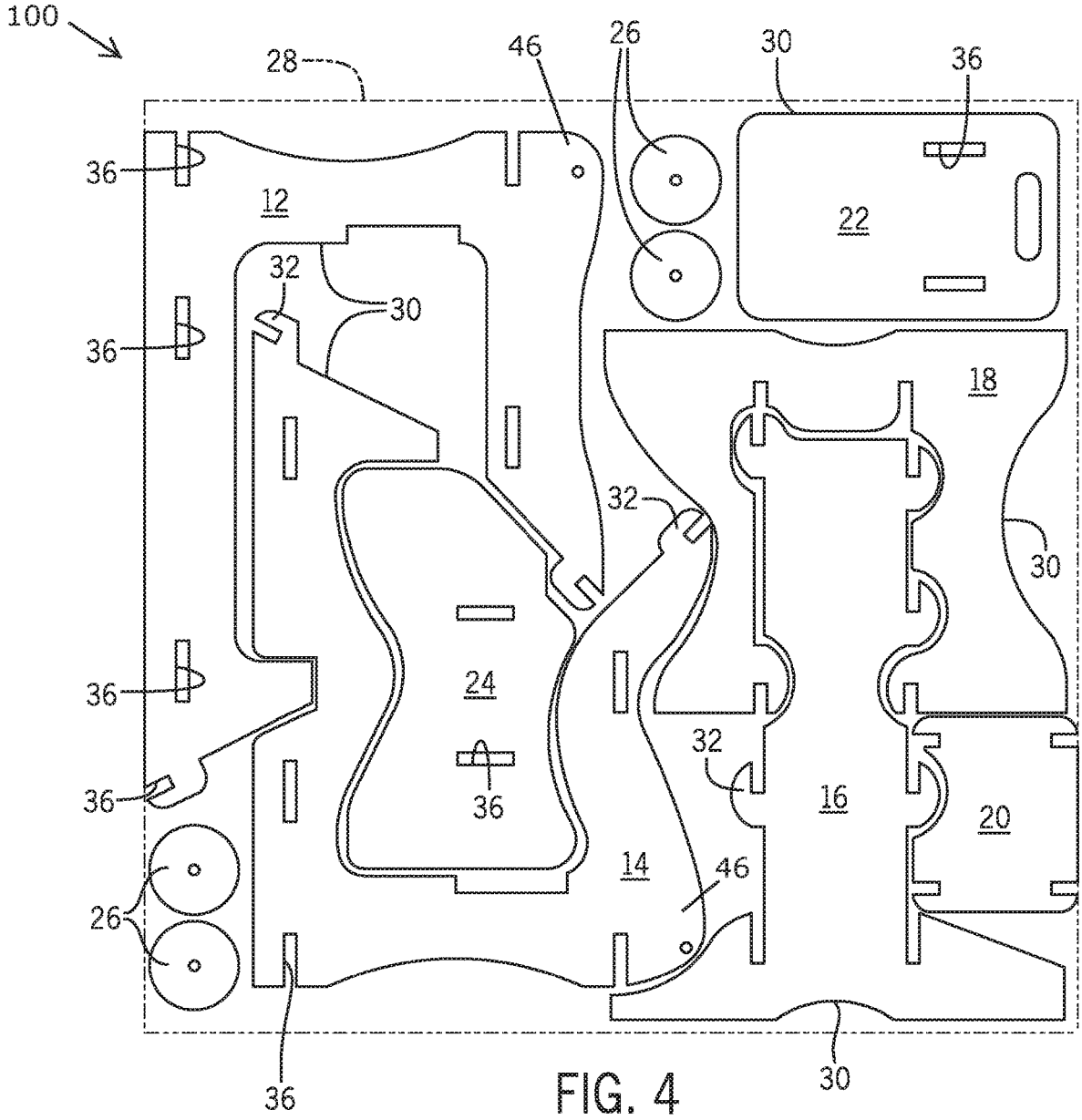
FIG. 4 is a top plan view of an exemplary embodiment of the present invention, showing the layout defining the constituent components.

Referring to FIG. 4, the planar blank 28 may define the entirety of the structural components, including a right-side component 12, a left-side component 14, a rear end component 16, a front-end component 18, a bottom end component 20, a seat component 22, a knee support component 24, and a plurality of wheels 26. Definition of said components 12-26 may be provided through cut lines 30 enabling individuals to remove each component from the planar blank 28 for assembly. Each component may provide tabs 32 and open and/or closed slots 36 and/or 34 for operatively engaged adjacent pieces in the predetermined assembly 10, as illustrated in FIGS. 1 through 3.

In use, the right-side component 12 and the left-side component 14 are generally U-shaped and spaced apart by the spaced apart rear end and front-end components 16 and 18. The bottom component 20 interconnects the side components 12 and 14 and is disposed between the spaced apart end components 16 and 18. The bottom components 20 acts as a foot rest and structurally contributes to the present inventions stability and integrity as it locks the two upright components 12 and 14, preventing them from twisting in their keyed slotted hole connections between the front and back dividers (rear end and front-end components) 16 and 18.

In one embodiment, the side components 12 and 14 provide the open slots 36 for engaging the slots and tabs 32 of the end components 16 and 18. The side components 12 and 14 have coextensive distal portions 42 and proximal portions 44. The seat component 22 engages the proximal portions 44, while the knee support component 24 engages the distal portions 42. In some embodiments, the distal and proximal portions 42 and 44 may provide tabs 32 for engaging the closed slots 34 of the seat and knee support components 22 and 24.

The side and end components 12, 14, 16 and 18 provide coplanar surfaces for supporting the assembled economic chair 10 along a supporting surface. The side components 12 and 14 may have coextensive wheel portions 46 for rotatably engaging the plurality of wheels 26 so that the assembled economic chair 10 may be moved through tilting said chair 10 onto said wheels 26.

The proximal portions 44 extend from the supporting surface a greater distance than the distal portions 42 extend so that the seat component 22 is disposed at a first elevation relative to the supporting surface, while the knee support component 24 is disposed at a second elevation relative to the supporting surface, the first elevation being a greater distance than the second elevation, thus providing an elevated posterior profile, wherein the seat component 2 is higher than the knee support component 24 during use. The seat component 22 and the knee support component 24 may be angle downward toward each other from the proximal portions 44 and distal portions 42, respectively.

When assembled, the present invention enables gravity to secure the interconnections of the tab-slot or slot-slot engaged joints, thereby eliminating the need for separate (metal) fasteners.

Any reasonable person can assembly the constituent components 12-26. When assembled, a human user may sit on the seat component 22 and rest their knees over the knee support component 24, thereby enabling the user to sit in an elevated posterior position, making higher countertops and table tops accessible in a seated position.

In certain embodiments, foam cushioning (not shown) or layers may be provided to improve comfort.

It should be understood, of course, that the foregoing relates to exemplary embodiments of the invention and that modifications may be made without departing from the spirit and scope of the invention as set forth in the following claims.

What is claimed is:

1. A system for providing the components for assembling a knee-rest chair in a planar arrangement, comprising:

a planar blank of one material defining a plurality of components comprising:

two U-shaped upright components having coextensive distal portions and coextensive proximal portions, wherein the proximal portions extend farther from a base portion of each U-shaped upright component;

two intermediate components for spacing the two U-shaped upright components apart of the assembled knee-rest chair;

a seat component adapted to operatively engage the proximal portions of the assembled knee-rest chair;

a knee support component adapted to operatively engage the distal portions of the assembled knee-rest chair; and a bottom component disposed between the two intermediate components and interconnecting said base portions of the assembled knee-rest chair.

2. The system of claim 1, further comprising a plurality of tabs and/or slots on each of the plurality of components for operatively engaging each other for providing the assembled knee-rest chair without the use of separate fasteners.

3. The system of claim 1, further comprising a plurality of wheels defined by the planar blank, wherein the two upright components provide two wheel portions for rotatably associating with the plurality of wheels of the assembled knee-rest chair.

4. The system of claim 1, wherein the planar blank is made of only wood.

5. The system of claim 1, wherein the planar blank is made of only plywood.

6. The system of claim 1, wherein the planar blank is 48 by 48 inches square.

7. A system for providing the components for assembling a knee-rest chair in a planar arrangement, comprising:

a planar blank of one material defining a plurality of components comprising:

two U-shaped upright components having coextensive distal portions and coextensive proximal portions, wherein the proximal portions extend farther from a base portion of each U-shaped upright component;

two intermediate components for spacing the two U-shaped upright components apart of the assembled knee-rest chair;

a seat component adapted to operatively engage the proximal portions of the assembled knee-rest chair; and a knee support component adapted to operatively engage the distal portions of the assembled knee-rest chair;

a plurality of tabs and/or slots on each of the plurality of components for operatively engaging each other for providing the assembled knee-rest chair without the use of separate fasteners;

a bottom component disposed between the two intermediate components and interconnecting said base portions of the assembled knee-rest chair; and a plurality of wheels defined by the planar blank, wherein the two upright components provide two wheel portions for rotatably associating with the plurality of wheels of the assembled knee-rest chair.

8. The system of claim 7, wherein the planar blank is made of only wood.

9. The system of claim 7, wherein the planar blank is made of only plywood.

10. The system of claim 7, wherein the planar blank is 48 by 48 inches square.

11. A system for providing the components for assembling a knee-rest chair in a planar arrangement, comprising:

a planar blank of one material defining a plurality of components comprising:

two U-shaped upright components having coextensive distal portions and coextensive proximal portions, wherein the proximal portions extend farther from a base portion of each U-shaped upright component;

two intermediate components for spacing the two U-shaped upright components apart of the assembled knee-rest chair;

a seat component adapted to operatively engage the proximal portions of the assembled knee-rest chair;

a knee support component adapted to operatively engage the distal portions of the assembled knee-rest chair; and a plurality of wheels defined by the planar blank, wherein the two upright components provide two wheel portions for rotatably associating with the plurality of wheels of the assembled knee-rest chair.

12. The system of claim 11, further comprising a plurality of tabs and/or slots on each of the plurality of components for operatively engaging each other for providing the assembled knee-rest chair without the use of separate fasteners.

13. The system of claim 11, wherein the planar blank is made of only wood.

14. The system of claim 11, wherein the planar blank is made of only plywood.

15. The system of claim 11, wherein the planar blank is 48 by 48 inches square.

* * * * *